US005731488A

United States Patent [19]

Plee

[11] Patent Number: 5,731,488

[45] Date of Patent: Mar. 24, 1998

[54] METHOD FOR THE PURIFICTION OF A PARAFFIN CUT

[75] Inventor: Dominique Plee, Bizanos, France

[73] Assignee: CECA S.A, Puteaux, France

[21] Appl. No.: 804,480

[22] Filed: Feb. 21, 1997

[30] Foreign Application Priority Data

Feb. 21, 1996 [FR] France ..... 96 02151

[51] Int. Cl.[6] ..... C07C 7/12; C10G 25/00

[52] U.S. Cl. ..... 585/820; 208/310 Z

[58] Field of Search ..... 585/820; 208/310 Z

[56] References Cited

U.S. PATENT DOCUMENTS

| | | | |
|---|---|---|---|
| 2,988,502 | 6/1961 | Ricards et al. | 208/310 Z |
| 3,228,995 | 1/1966 | Epperly et al. . | |
| 3,278,422 | 10/1966 | Epperly et al. | 208/310 |
| 3,723,561 | 3/1973 | Priegnitz . | |
| 3,969,223 | 7/1976 | Rosback et al. | 208/310 Z |
| 4,567,309 | 1/1986 | Kulprathipanja | 585/829 |
| 4,567,315 | 1/1986 | Owaysi et al. | 585/827 |
| 5,171,923 | 12/1992 | Dickson | 585/821 |
| 5,173,462 | 12/1992 | Plee | 502/67 |
| 5,198,102 | 3/1993 | Kaul et al. | 208/310 Z |
| 5,220,099 | 6/1993 | Schreiner et al. | 585/820 |

FOREIGN PATENT DOCUMENTS

| | | |
|---|---|---|
| 0 164 905 | 12/1985 | European Pat. Off. . |
| 2 669 242 | 11/1990 | France . |

*Primary Examiner*—Elizbeth D. Wood
*Attorney, Agent, or Firm*—Bell, Boyd & Lloyd

[57] ABSTRACT

Paraffin cuts contaminated with aromatic compounds are brought in contact at ambient temperature with faujasites, in which the Si/Al ratio is less than 1.2, in particular, sodium faujasites which were partially exchanged with lithium. Thus, one can obtain purified cuts which are practically totally free from aromatic contaminants.

6 Claims, No Drawings

METHOD FOR THE PURIFICTION OF A PARAFFIN CUT

FIELD OF THE INVENTION

The invention is concerned with the separation of hydrocarbons and more particularly with a method of purification of a hydrocarbon cut from the aromatic compounds it contains. More specifically, the invention deals with the possibility of carrying out the cited operation by adsorption on a molecular sieve. More precisely, its object is the purification of normal paraffin cuts containing aromatic compounds as impurities.

BACKGROUND OF THE INVENTION

It is of prime importance that the normal paraffins, which are widely used chemical products, be as pure as possible regarding their aromatic compound content. The paraffins in question represent the base for synthesizing detergent molecules such as alkylsulfonates or alkylarylsulfonates. Apart from this utilization in the detergent industry, paraffins have varied applications as solvents or as chemical intermediates, for example, in aromatization or alkylation reactions.

The reason why paraffins are frequently contaminated with aromatic compounds must be looked for in the fact that they are produced from petroleum, kerosene or gasol of the Fisher-Tropsch process cuts formed from very different molecules, among which one can cite aromatic compounds, naphthenic compounds, olefinic-type compounds or linear or branched saturated compounds.

The commercial specifications of paraffin cuts that are used among others for the production of detergent molecules tend to become more and more severe: the present values are less than 1000 ppm.

To obtain hydrocarbon cuts consisting principally of normal paraffins by adsorption on molecular sieves is a well-known process that one can see, for example, in U.S. Pat. No. 2,988,502, assigned to Esso Research and Engineering Co., which describes a method for obtaining normal paraffins by contacting a mixture of hydrocarbons in a gas phase with an adsorbent consisting of a molecular sieve.

There are other patents which deal with the methods of separation or purification of hydrocarbons. The possibility of separating butene-1 from a mixture containing at least one other C4 monoolefin by adsorption on a type Y or X zeolite, exchanged by cations such as potassium or barium, is described in the document U.S. Pat. No. 3,723,561 (UOP). The U.S. Pat. No. 3,969,223 (UOP) discloses a method of separation of an olefin from a hydrocarbon mixture consisting of olefins and of saturated compounds using an X-type zeolite treated for a certain period of time in a sodium hydroxide solution and then washed; the purpose of this treatment is to extract a small fraction of the silica and alumina present in the sieve or in the agglomeration binder (constituted by silica, alumina or by a silica-alumina), and, as a claimed secondary effect, to bring the $Na_2O/Al_2O_3$ ratio as close to 1 as possible.

Another method of separation of hydrocarbons concerns the adsorption of 1,3-butadiene on active carbon or a carbonated molecular sieve from a mixture comprising at least one other C4 hydrocarbon and is described in U.S. Pat. No. 4,567,309 in the name of UOP. The following pairs are cited: 1,3-butadiene/n-butane; 1,3-butadiene/isobutylene; 1,3-butadiene/trans-butene or 1,3-butadiene/cis-butene.

In the more specific area of adsorption of aromatic compounds starting from hydrocarbon mixtures, one can mention U.S. Pat. No. 3,278,422 (Esso Research and Engineering Co.) which describes a method for the elimination of aromatic compounds contained in kerosene, petroleum or a lubricating oil by adsorption. The method can be carried out in the liquid phase, but preferably one operates in the gas phase. The goal of this treatment is to improve the thermal stability of these pairs of hydrocarbons, the objective being reached as soon as the level of the aromatic hydrocarbon decreases below 3%. The zeolite used is a faujasite, either in the Na form or exchanged with a divalent ion. Another document, U.S. Pat. No. 3,228,995 (Esso Research Engineering Co.), teaches more specifically as to how one can eliminate the aromatic compounds from a paraffin cut by adsorption on molecular sieves of type X, exchanged by monovalent or divalent ions. The levels of purification reached according to these methods are today judged completely insufficient.

It has been known for numerous years that zeolites are capable of fixing certain molecules selectively. In certain cases, the selectivity is practically total, which means that in a mixture of two types of molecules, one can be adsorbed almost completely while the other is excluded almost completely; this property was what gave zeolite the name of molecular sieve and it follows from the fact that, in the majority of cases, the zeolites are crystalline aluminosilicates formed by condensation of silica tetrahedra and alumina tetrahedra with the aid of bridging oxygen atoms. The arrangement of these species in space results in the formation of pores and cavities, the dimensions of which are particularly uniform. Only molecules the size of which is less than the diameter of the pore can penetrate into the crystal and be adsorbed. The pores vary between approximately 3 and 8 Angstroms (0.3 to 0.8 nm) according to the types of zeolites, but for a given zeolite, the pores have a perfectly calibrated size. One can find a description of these products in "Molecular Sieves Zeolites" by D. W. BRECK, John Wiley and Sons, 1974.

Among the zeolites which have molecular sieve properties and which are used for this purpose, one can cite original natural products, such as clinoptilolite, chabazite, mordenite, erionite or products of synthetic origin, such as zeolites of type A (LTA in the international classification), zeolites of type X or Y (FAU in the international classification), pentasil-type zeolites (MFI or MEL). There are other products also, which have the properties of molecular sieves but the utilization of which is rather in the field of catalysis, such as zeolites of the offretite-type (OFF), omega-type (MAZ), ferrierite-type (FER) or mordenite-type (MIR).

In adsorption, the zeolites of the faujasite-type, to which the X and Y types belong, are very frequently employed because of their large pore volume and because the size of the pores permit penetration of molecules with a relatively large volume, such as aromatic or even polyaromatic molecules. On the other hand, the interest in these solids rests in the fact that one can vary the Si/Al ratio within a wide range, which modifies, sometimes considerably, the interaction of the molecules with the crystal or with the inside of the structure. These studies showed that zeolites of type X, the pores of which have an opening of 8 Angstrom (0.8 nm) show a large affinity to species such as n-dodecylbenzene, naphthalene or dibenzothiophene in comparison to either paraffinic, or naphthenic molecules (see in this regard SATTERFIELD, C. N. and CHEN, C. S. AichE Journal, Vol. 18, No. 4, p. 720, 1972, or AHMETOVIC D. and SVELCEROVECKI S. Zeolites, Synthesis, Technology and Applications, 1985, p. 683).

On the other hand, work related to the influence of the Si/Al ratio in faujasites showed that the products which contain more alumina adsorbed aromatic compounds in preference to saturated molecules (SATTERFIELD C. N., CHEN C. S. and SMEETS J. K., AichE Journal, Vol. 20, p. 612, 1974) while the reverse behavior was observed for an Si/Al ratio greater than 30 (DESSAU R. M. "Adsorption and Ion Exchange with Synthetic Zeolites", A.C.S. Symp. Ser., 135, p. 123, 1980).

The desorption step of the adsorbed aromatic compound was examined by AHMETOVIC D. and BECK I. ("Zeolites for the Nineties", Recent Research Report, 8th Int. Zeolite Conf., Jul. 10–14, 1989, Amsterdam), who, after having adsorbed the aromatic compounds contained in white spirit, experimented with various methods of desorption and showed that ammonia is preferable to nitrogen.

The adsorbents used until now for the elimination of aromatic compounds are thus faujasite-type molecular sieves which are commonly called 13X or 10X in the profession. These materials, consisting of arrangement of silicon oxide and aluminum oxide tetrahedra possess a negative electric charge because the aluminum which is a trivalent element, substitutes for the silicon, which is a tetravalent element. The charge in question is compensated by a cation, generally chosen from the alkali or alkaline-earth elements. Naturally, these cations are hydrated in the zeolite cavities and can be exchanged by simply contacting these with a solution of another cation, in the form of chloride, nitrate, oxalate, acetate, or sulfate. (Other anions may be used without special difficulty and the list cited above is not exhaustive). These exchange operations are well-known to the person in the field and can be carried out within a large range of salt concentrations, solid/liquid ratio, temperature or duration. The molecular sieves 13X or 10X refer to faujasites in which the Si/Al ratio is between 1.2 and 1.5, the usual composition range for these products. The term 13X refers more particularly to a solid in which the compensating cation is sodium and the term 10X refers to a solid in which the compensating cation is calcium.

Although it was recognized in the articles cited above that the Si/Al ratio (for values greater than 2.5) could have an importance in the selectivity between aromatics and paraffins, after reading the documents of industrial property, one notes that the adsorbents used are very generally 13X zeolites, 10X zeolites or Y zeolites in which the Si/Al ratio is between 1.5 and 3; curiously, the range of ratios below 1.2 has not been explored for this application.

DESCRIPTION OF THE INVENTION

Now the Applicant found, and this is what constitutes the present invention, that, in order to eliminate the aromatic compounds from paraffin cuts which contain from approximately 0.1 to approximately 2% of these, it was particularly advantageous to treat them by contact in the liquid state at ambient temperature with a faujasite, the Si/Al ratio of which is less than 1.2. Moreover, the introduction of certain alkali or alkaline-earth cations in the exchange position, in particular, lithium, permits one to increase this selectivity in comparison to the sodium form of the solid. The reason for this behavior is not known to the Applicant, but it is possible that selectivity effects are due either to a variation of the partial charge carried by the oxygen atoms, which determines the basicity of the solid, or to the change of the micropore volume caused by the fact that the introduced cation has a different size.

The faujasites, which are the means of the invention, are used in the form of beads or granules. Beads of small diameter (0.5 to 1 mm) are preferred. The industrial treatment is carried out preferentially by percolation through columns, which permits one to control the conditions for obtaining paraffins with the desired degree of purity, possibly at aromatic contents which are undetectable by the ordinary means of analysis. The faujasites which are saturated with aromatic compounds can be regenerated according to methods well known to the person in the field. The paraffin cuts obtained from the separation process MOLEX particularly benefit from the treatment according to the invention.

EXAMPLES

The examples which follow will permit one to get a more precise idea of the invention.

Experimentally, the selectivity between aromatics and paraffins is determined as follows:

- A stock solution is prepared which comprises 495 grams of n-decane and 5 grams of diisopropylbenzene. This is then brought into contact at 25° C. with 1 gram of adsorbent, the preparation conditions of which are described below, using 10 grams of the stock solution, and for 3 hours.
- The supernatant is analyzed by gas chromatography using isooctane as internal standard; a possible variation to analyze the aromatic contents in the paraffin cut consists in carrying out a determination by UV spectrometry.
- The selectivity between the aromatic compound and the paraffin is expressed by the following formula:

$$N_{ar}(z).N_{pa}(s)/N_{ar}(s).N_{pa}(z)$$

where $N_{ar}$ and $N_{pa}$ represent the number of moles of the aromatic compound and the number of moles of the paraffin compound, respectively, and where the indices (z) and (s) refer respectively to the zeolite phase and the solution phase.

Example 1

A zeolite of the faujasite-type and with an Si/Al ratio equal to 1 is synthesized according to Example 1 of FR-A-2,669,2423 (CECA S.A.) in which a gel was prepared with the following composition:

$$4.87Na_2O—1.63K_2O—2SiO_2—Al_2O_3—H_2O$$

which is subjected first of all to aging for about 20 hours at 50° C. and to crystallization for 4 hours at 100° C. After filtration and washing, the crystals are identified by x-ray diffraction as consisting of pure faujasite. Analysis of the solid gives an Si/Al ratio equal to 1.01, an $Na_2O+K_2O/Al_2O_3$ ratio equal to 1 and an adsorption capacity for toluene in the gas phase of 22.8% at 25° C. and under a partial pressure of 0.5.

Example 2

The solid thus obtained is exchanged with calcium or lithium by bringing it into contact several times with molar solutions of these salts at a temperature of the order of 70° C. The solids thus exchanged are then calcined at 550° C. for 2 hours in a dry nitrogen atmosphere, then stored in the absence of air. Simultaneously, a commercial zeolite 13X made by CECA S.A. is calcined under the same conditions. These zeolites, in the calcined state, have characteristics indicated in the table below, where M represents an alkali metal other than sodium or an alkaline-earth metal and n is its valence:

| toluene adsorption (%) | Si/Al | $M_nO/(M_nO + Na_2O)$ |
|---|---|---|
| 23 | 1.25 | 0 |
| 25 | 1 | 0.9 ($M_n$ = Li) |
| 22.7 | 1 | 0.88 ($M_n$ = Ca) |

Example 3

Another fraction of commercial 13X zeolite is exchanged by calcium, barium and potassium salts by bringing it into contact several times with 1 molar solutions at a temperature of the order of 70° C. The solids thus obtained are then subjected to the same calcining treatment as the samples of Example 2.

The characteristics of these zeolites are given in the table below, in which M again represents an alkali metal other than sodium or an alkaline-earth metal, and n is its valence:

| toluene adsorption (%) | $M_nO/(M_nO + Na_2O)$ |
|---|---|
| 23 | 0.89 ($M_n$ = Ca) |
| 18.9 | 0.85 ($M_n$ = Ba) |
| 21.1 | 0.95 ($M_n$ = K) |

Example 4

The commercial zeolite 13X of Example 2 and the stock solution previously described are brought into contact. The same operation is carried out for the zeolite ratio Si/Al=1 of Example 1. This zeolite will be called FAU 1. The table below gives the results:

| adsorbent | selectivity |
|---|---|
| 13X | 900 |
| FAU 1 | 1700 |

It appears that the zeolite with a ratio of Si/Al=1 is remarkably superior with regard to selectivity in comparison to its homolog with a ratio having Si/Al=1.2 for the same type of compensating cation.

Example 5

Zeolites 13X and FAU 1, exchanged with calcium (called CaX and CaFAU 1, respectively) are brought into contact with the stock solution under the conditions described above. The stock solution is also brought into contact with the zeolites 13X exchanged with potassium and barium (called KX and BaX, respectively). The results of the selectivity are reported in the table below:

| adsorbent | selectivity |
|---|---|
| CaX | 610 |
| KX | 500 |
| BaX | 360 |
| CaFAU 1 | 1200 |

These results confirm the importance of the Si/Al ratio being as low as possible and we find that the order of increasing selectivity is: BaX<KX<CaX<NaX. It can be deduced from this that the selectivity diminishes with increasing charge and size of the cation.

Example 6

Zeolite FAU 1 exchanged with lithium and the stock solution are brought into contact to determine the selectivity as described above. The comparative results between FAU 1 and FAU 1 lithium are given in the table below:

| adsorbent | selectivity |
|---|---|
| FAU 1 | 1700 |
| LiFAU 1 | 2100 |

These results confirm that the best result is obtained with a low Si/Al ratio and a cation of small size, such as lithium.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

I claim:

1. Method comprising eliminating aromatic component from a paraffin cut, which contains about 0.1 to about 0.2 weight % of aromatic components, by contacting at ambient temperature this parafin cut in the liquid state with a faujasite, the faujasite having an Si/Al ratio from about 1 to less than 1.2.

2. Method according to claim 1, wherein the faujasite is a sodium faujasite partially exchanged by an alkali cation different from sodium or by an alkaline-earth cation.

3. Method according to claim 2, wherein the faujasite is partially exchanged with lithium.

4. Method according to claim 2, wherein the faujasite is partially exchanged with potassium.

5. Method according to claim 2, wherein the faujasite is partially exchanged with calcium.

6. Method according to claim 2, wherein the faujasite is partially exchanged with barium.

* * * * *

UNITED STATES PATENT AND TRADEMARK OFFICE

CERTIFICATE OF CORRECTION

PATENT NO. : 5,731,488

DATED : March 24, 1998

INVENTOR(S) : Plee

It is certified that error appears in the above-identified patent and that said Letters Patent is hereby corrected as shown below:

Title page, item [54] and col. 1, line 1, delete "PURIFICTION" and insert therefor -- PURIFICATION--.

Column 4, lines 43 to 44, change "FR-A-2,669,2423 to --FR-A-2,669,242--.

Signed and Sealed this

Twenty-second Day of September, 1998

*Attest:*

Bruce Lehman

BRUCE LEHMAN

*Attesting Officer*

*Commissioner of Patents and Trademarks*